United States Patent [19]

Shannon, Jr.

[11] 4,022,330

[45] May 10, 1977

[54] APPARATUS FOR MOUNTING BUILDING PANELS

[76] Inventor: Joseph R. Shannon, Jr., P.O. Box 40006, Houston, Tex. 77040

[22] Filed: May 16, 1975

[21] Appl. No.: 578,127

[52] U.S. Cl. ..... 214/1 H; 52/749; 187/2; 214/1 SW

[51] Int. Cl.[2] ..... E04G 21/00

[58] Field of Search ..... 214/1 H, 1 SW, 658; 52/745, 747, 749; 187/2, 6

[56] References Cited

UNITED STATES PATENTS

| | | | |
|---|---|---|---|
| 3,433,459 | 3/1969 | Logan | 214/658 X |
| 3,791,094 | 2/1974 | Shannon | 214/1 H X |
| 3,851,736 | 12/1974 | Westlake | 52/745 X |

FOREIGN PATENTS OR APPLICATIONS

| | | | |
|---|---|---|---|
| 864,960 | 4/1961 | United Kingdom | 187/6 |

*Primary Examiner*—L.J. Paperner
*Assistant Examiner*—George F. Abraham
*Attorney, Agent, or Firm*—Pravel, Wilson & Gambrell

[57] ABSTRACT

A new and improved apparatus for mounting panels on a building, wherein the apparatus with a plurality of building panels thereon is raised alongside a building structure by a crane or similar lifting equipment connected to the upper end thereof, so that the panels can be mounted on the building structure from the apparatus to form a wall thereof at the third and higher stories of the building.

4 Claims, 4 Drawing Figures

APPARATUS FOR MOUNTING BUILDING PANELS

BACKGROUND OF THE INVENTION

The field of this invention is apparatus for mounting building panels.

Building panels, particularly corrugated asbestos sheets or panels, are relatively heavy and cumbersome to handle and install on a building framework or other structure. When making a large commercial or industrial building, it is usually necessary to elevate such panels from the ground level and install them at second, third or even higher tiers to form the complete walls.

Prior art apparatus for mounting building panels include the use of scaffolding suspended by ropes from the building structure and pulleys mounted on the building requiring a multiple-man operation to both lift the panels separately from the ground to the appropriate level as well as those on the scaffolding to install the same on the building. Other prior art apparatus for mounting building panels includes apparatus such as disclosed in U.S. Pat. No. 3,791,094 which was lifted by fork-lift equipment and was therefore limited to use about the second or third story of a building and lower.

SUMMARY OF THE INVENTION

The present invention relates to a new and improved apparatus for mounting building panels on a building structure, wherein a panel transferring mechanism is movably mounted at the upper end of a frame structure for manipulating building panels from the base of the frame structure to position same adjacent the building structure, and further having means for releasably connecting the frame structure with a supportive mechanism such as a crane for elevating the apparatus from a lower level to relatively high selected elevated positions, such as the third story of a building and thereabove.

DESCRIPTION OF THE PREFERRED EMBODIMENT

Figure 2:
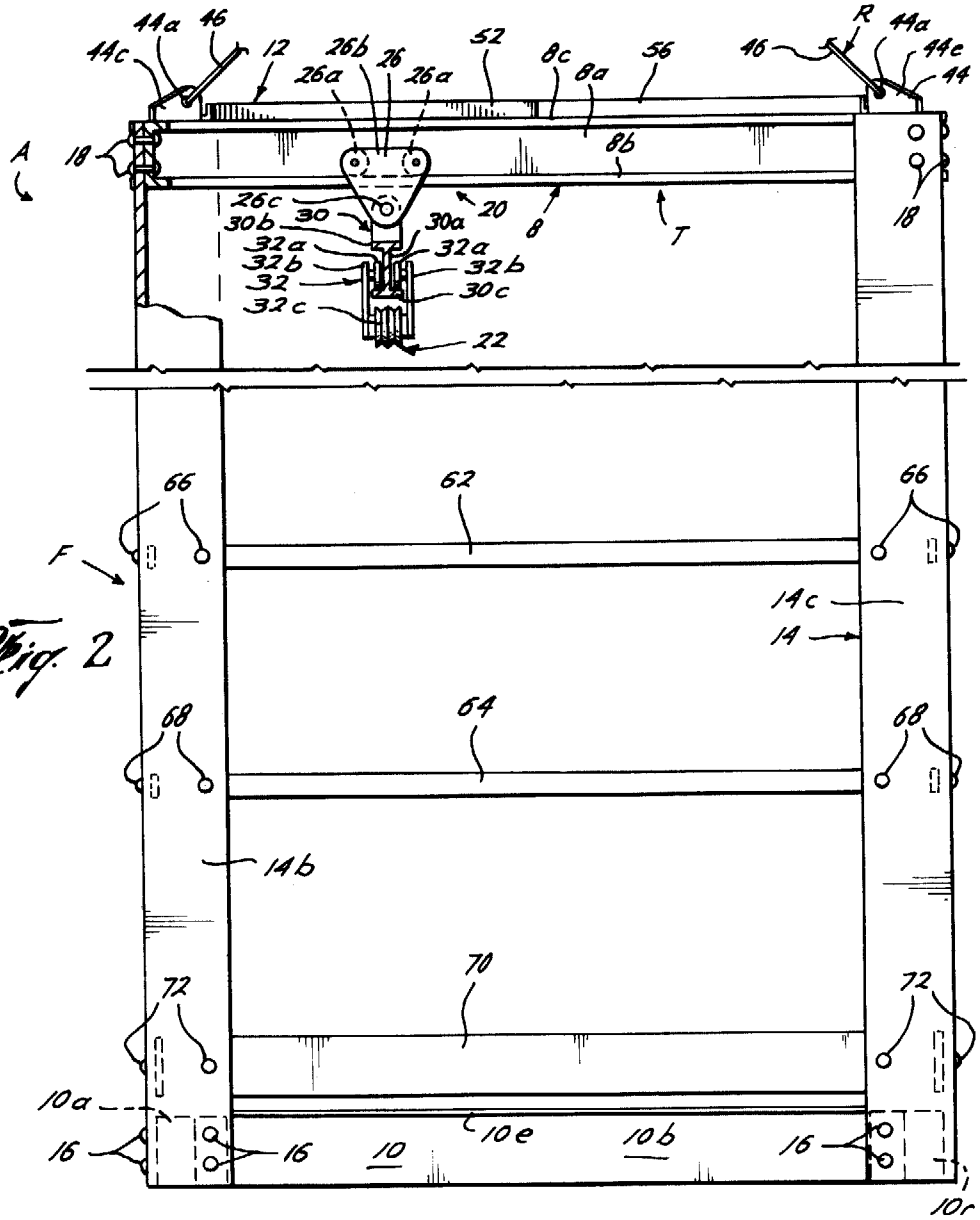
FIG. 2 is a rear elevation, partly in section, illustrating the apparatus of the present invention.

In the drawings, the letter A designates generally the apparatus for mounting building panels of the present invention which is adapted to be elevated and moved from a lower level to an elevated level by a supportive mechanism S such as a crane or similar well-known lifting equipment typically having a boom with a lifting hook operable by a hoist mechanism. The apparatus A includes a frame structure F having a panel transferring means T mounted therewith for raising building panels P from the frame structure F and moving the raised panel P laterally relative to the frame structure F for positioning the same for mounting on the building structure B. The apparatus A further includes a releasable connecting means R for releasably connecting the frame structure F with the supportive mechanism S for elevating the frame structure F from the lower level to an elevated position.

The apparatus A of the present invention includes a frame structure F adapted to receive at least one man thereon. The frame structure F is preferably made of steel or any other suitable high-strength material capable of taking heavy stresses and strains without failure thereof. The frame structure F includes a base portion 10 and a top portion 12. The base portion 10 is formed preferably of angle iron, rectangular or tubular steel or any other suitable material such as members 10*a*, 10*b*, 10*c*, 10*d*. A base plate 10*e* is welded or otherwise suitably mounted with members 10*a*–10*d*. Vertical frame members 14 include upstanding members 14*a*, 14*b*, 14*c*, 14*d* made of angle iron or any other suitable material which are suitably affixed with the base portion 10 by fastening bolts 16 or any other suitable means. The top portion 12 is mounted adjacent the upper portion of the vertical frame members 14 with bolts or fasteners 18 or any other suitable connection means. The top portion 12 includes channel members 6, 7, 8, 9 of preferably an I-beam construction wherein each of members 6–9 have webs 6*a*–9*a*, lower flanges 6*b*–9*b* and upper flanges 6*c*–9*c*, respectively.

The panel transferring means T of the apparatus A of the present invention is mounted with the top portion 12 of the frame structure F. The panel transferring means T includes a movable support means designated generally as 20 for supporting and moving at least one building panel P laterally relative to the base portion 10 of the frame structure F. The support means 20 is movably mounted with the top portion 12 of the frame structure F. Further, the panel transferring means T includes a hoist means designated generally as 22 for raising the building panels P off of the base portion 10 of the frame structure F and a hoist means 22 being mounted with the movable support means 20.

The movable support means 20 includes trolleys 24, 26 each having a plurality of rollers 24*a*, 26*a*, respectively, which rollably engage channel members 6, 8 at the lower flanges 6*b*, 8*b* having webs 6*a*, 8*a* therebetween the pairs of opposed rollers 24*a*, 26*a* of trolleys 24, 26. As shown in the drawings, preferably the trolleys 24, 26 have rollers 24*a*, 26*a* in opposed pairs such that the members 6, 8 are engaged in such a fashion that the trolleys 24, 26 are constrained to move in the direction of arrow 28 (FIG. 4) along the longitudinal axis of members 6, 8 without becoming disengaged from the members 6, 8, respectively. The rollers 24*a*, 26*a* are preferably mounted to plate 24*b*, 26*b* of trolleys 24, 26, respectively. Pins 24*c*, 26*c* are suitably mounted with plates 24*b*, 26*b* for mounting the boom 30 therewith.

The boom 30 is preferably formed of an I-beam member having a web 30*a*, upper flange 30*b*, and lower flange 30*c*. Boom supports 30*d*, 30*e* have suitable openings (not numbered) formed therein and adapted to receive pins 24*c*, 26*c*, respectively, from trolleys 24, 26 to movably mount the boom 30 therewith. The boom supports 30*d*, 30*e* are preferably mounted or affixed to the upper flange 30*b* of boom 30.

Figure 3:
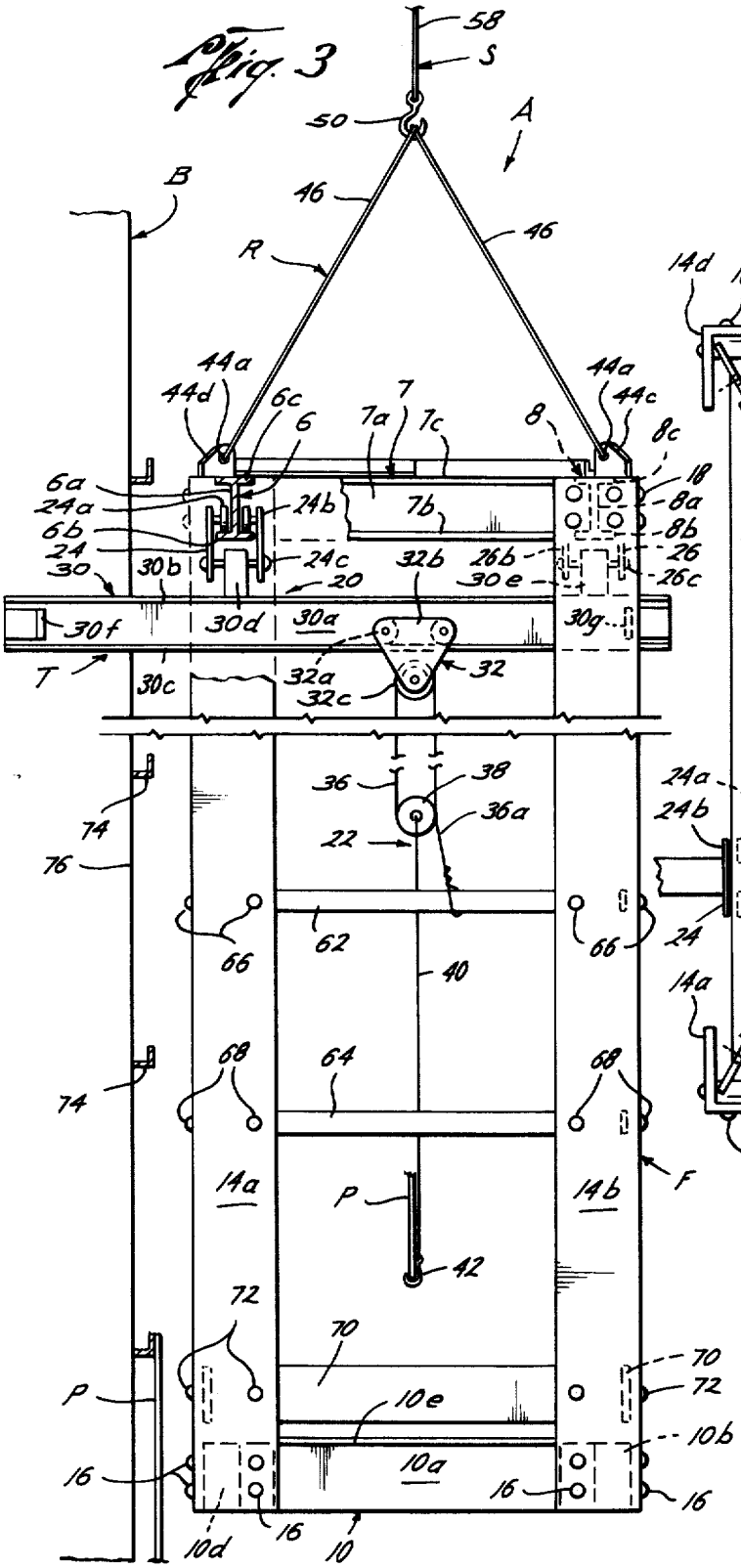
FIG. 3 is a side elevation, partly in section, showing the apparatus for mounting building panels of the present invention adjacent a building structure; and, FIG. 4 is a plan view of the apparatus for mounting building panels of the present invention.
Figure 4:
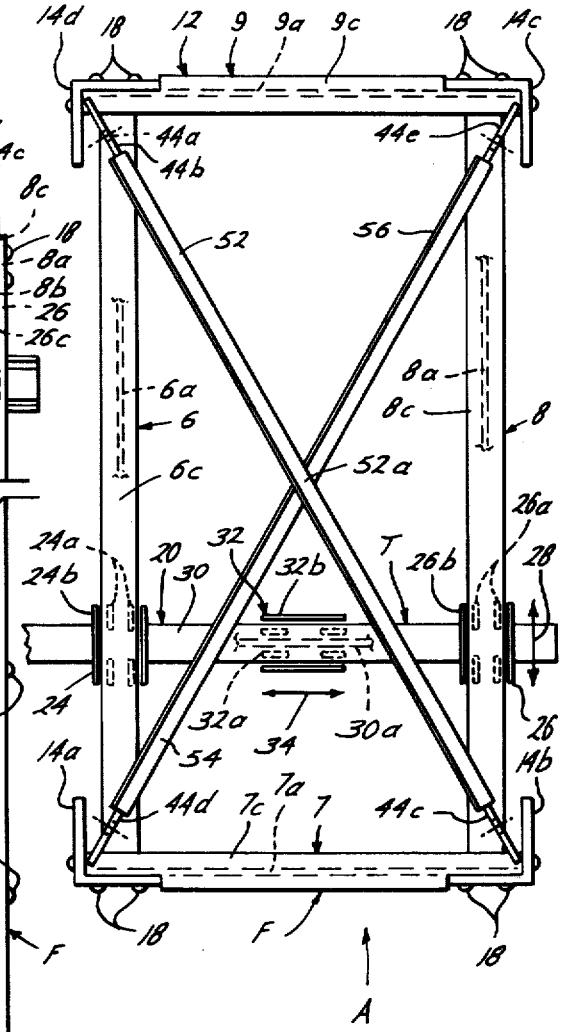

Hoisting trolley 32 is movably mounted with the boom 30. The hoisting trolley 32 includes rollers 32*a* mounted thereto plates 32*b* and further having pulley 32*c* mounted therewith. The rollers 32*a* of the hoisting trolley 32 are adapted to rollably engage the lower flange 32*c* having web 30*a* of the boom 30 therebetween so that hoisting trolley 32 may move along the longitudinal axis of the boom 30 in the direction of arrow 34 (FIG. 4). Suitable detents or stops 30*f*, 30*g* (FIG. 3) are formed with the boom 30 to constrain the movement of the hoisting trolley 32 therebetween detents 30*f*, 30*g* so that hoisting trolley 32 does not inadvertently roll off the end of the boom 30.

The hoist means 22 includes the pulley 32*c* of the hoisting trolley 32 which is adapted to receive pulley line 36 (FIG. 3) which engages pulley 38. Thus, pulley 38 as movably mounted with pulley 32*c* with line 36 forms a block and tackle arrangement such that movement of the end portion 36*a* of line 36 will cause appropriate elevational changes of pulley 38 with respect to pulley 32*c*. Line 40 is affixed to pulley 38 and has an appropriate hook or any other suitable means 42 mounted therewith and adapted to receivably engage the lowermost portion of a building panel P. Thus, any elevational movement of pulley 38 results in an elevational movement of hook 42 which is adapted to receivably engage the building panel P.

Apparatus A of the present invention is adapted to be moved from a lower level to an elevated position by a supportive mechanism S such as a crane or any other suitable mechanism capable of engaging the top portion 12 of the frame structure F. The releasable connecting means R for releasably connecting the frame structure F with the supportive mechanism S is preferably mounted with or affixed to the top portion 12 of the frame structure F. The releasable connecting means R includes tabular supports 44 mounted with the top portion 12 along the diagonal of the frame structure F and formed with openings 44*a* therein and adapted to receive a plurality of flexible lines 46 which terminate at a common upper point 48 for receiving a hook-like member 50 which is affixed in any well-known manner to the hoist line 58 of the crane or other similar supportive mechanism S (FIG. 3). Bracing member 52 preferably joins tabular supports 44*b* and 44*c* which are mounted diagonally in opposed corners of the top portion 12 (FIG. 4) and further having support braces 54, 56 appropriately mounted to tabs 44*d*, 44*e* at one end and mounted with bracing 52 at substantially the midpoint 52*a* thereof in a similar diagonal fashion as bracing 52 is mounted with tabular supports 44*b*, 44*c*. Members 52, 54, 56 provide additional support for the apparatus A upon upward urging of the hook-like member 50 with line 58 which is suitably mounted with the supportive mechanism S.

Safety means designated generally as 60 includes safety rails 62, 64 mounted on three sides of the frame structure F are for preventing personnel from inadvertently stepping or slipping off of the base portion 10 of the frame structure F. Safety rails 62, 64 are appropriately mounted with the vertical frame members 14 with fasteners 66, 68, respectively. The safety means 60 further includes toeplates 70 preferably mounted with all four sides of the frame structure F of the apparatus A adjacent to the base portion 10 for preventing personnel from inadvertently slipping off of the base portion 10 of the frame structure F. The toeplates 70 are preferably mounted with the vertical frame members 14 with suitable fasteners 72.

Although the building structure B may be formed in any suitable manner so long as it is capable of receiving the panels P, as illustrated in the drawings, the building structure B includes a plurality of horizontally extending angle iron members 74 which are mounted to a vertically extending member 76 of the building structure B, a portion of which is schematically illustrated in FIG. 3 of the drawings. It will be understood that the invention is not limited to the mounting of the panels P upon any particular kind of building structure, and the invention as described herein with respect to the building structure B is solely for illustrative purposes. It should be understood that the panels P are preferably and are normally of the asbestos-cement type which are extremely heavy and difficult for one man to handle.

Figure 1:
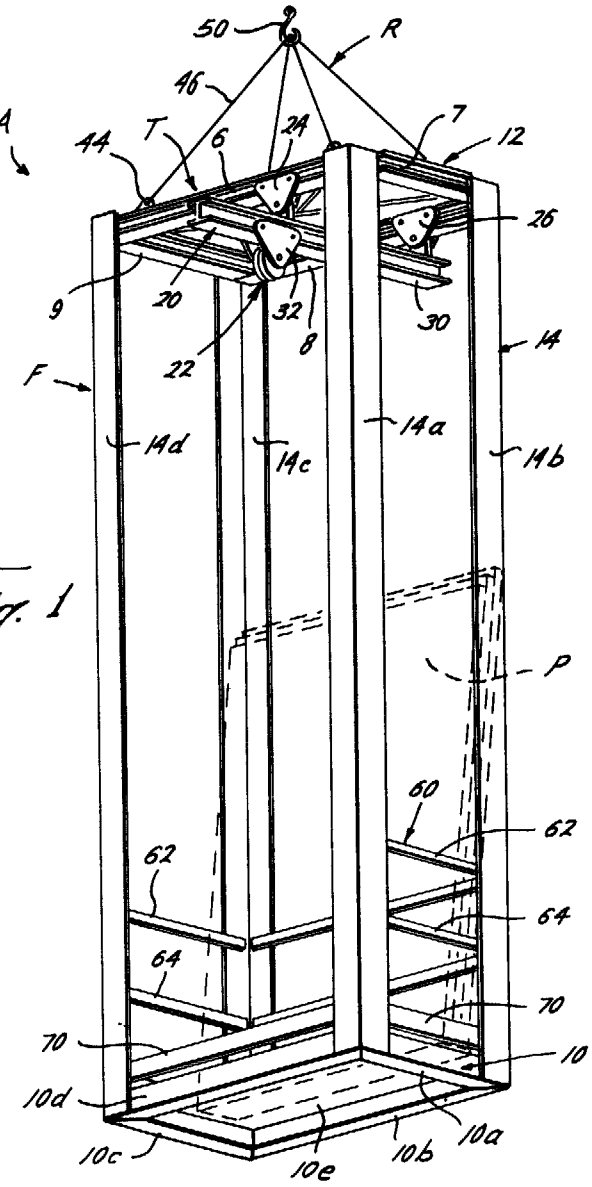
FIG. 1 is a front isometric of the apparatus for mounting building panels of the present invention.

In the use or operation of the apparatus A of the present invention, the apparatus A is raised from ground level or near ground level by the crane or similar supportive mechanism S having line 58 affixed to hook-like member 50 which hook 50 is operatively connected to the flexible lines 46 on the top of the frame F. Prior to raising the apparatus, a plurality of panels P are loaded onto the base portion 10 of the frame structure F. The panels P are positioned substantially vertically within the frame structure F or at an angle so that they lean against the vertical frame members 14 or safety rail 62 of the frame structure F as shown in FIG. 1.

Typically, there are one or two men who after the panels P are loaded onto the frame structure F, ride with the apparatus A while standing on the base plate 10*e* during the lifting or hoisting of the apparatus A to the desired elevation for the beginning of mounting the panels P to the building structure B. As illustrated in FIG. 3, the apparatus A has been raised to a second story of a building or some story thereabove, which is generally above a tier of panels P which have already been attached to the building structure B. The operator then engages the hook 42 below the panel P which is closest to him, which he may thereafter control by the appropriate movement of line 36*a*. Pulling the line 36*a* downwardly results in the panel P thus engaged by hook 42 to move upwardly in response thereto while a loosening of the tension on the line 36*a* allowing the same to move upwardly results in lowering of the panel P.

After the panel P has been raised upwardly by the operator pulling downwardly on line 36*a*, at the end of line 36, the operator positions the panel P so as to have the panel P between him and the building structure B. Movement of the panel P horizontally on the frame structure F is accomplished by the trolleys 24, 26 moving in the directions of arrow 28 along the members 6, 8, respectively. Movement of the panel P laterally along the boom 30 in the direction of arrow 34 is accomplished by trolley 32 moving along the lower flange 30*c* of the boom 30. Movement of the raised panel P is accomplished by the operator urging the raised panel in the desired direction. Thereafter, the raised panel P is positioned adjacent to the building structure B so that the panel P may be aligned therewith the members 74 for appropriately aligning and joining the panels P to the building structure B. Of course, during the fastening of the panel P, the panel transferring means T may be raised and/or lowered to facilitate the proper insulation of the panels P with the building B. It should be noted that since the boom 30 extends inwardly past the vertical member 76 (FIG. 3), it is assumed that the vertical member 76 is positioned with vertical spaces therebetween, which is usually the case. In other words, there is ample room for the boom 30 to extend into the building structure as illustrated in FIG. 3. However, the boom 30 can be of shorter length and can terminate at the edge of the building structure B if the building structure B is so made that the boom 30 cannot extend thereinto the space therebetween the vertical support 76.

The apparatus A is moved horizontally by moving the supportive mechanism S horizontally when desired to move the apparatus A for positioning the next panel P on the building structure B. In some instances, several panels P may be installed on the building structure B without horizontally or laterally moving the apparatus A but when that does become necessary, the entire apparatus A may be moved without lowering it back to the ground level, or if more convenient, the apparatus A may be lowered back to the ground level and then moved horizontally to locate the apparatus A for the positioning of the next panel P in the same manner as heretofore described with the first panel P. All of the panels P are thus mounted on the building structure B and when the supply of panels P on the apparatus A has thus been exhausted, the apparatus A is lowered back to the ground level and another group of panels P are mounted on the base portion 10 of the frame structure F and the procedure is repeated. Because of the structure of this apparatus A, with its panel transferring means T at the top of the frame structure F, and the releasable connection means R to the crane or supportive mechanism S being at the top, the elevations to which this apparatus A may be lifted is extremely enhanced as compared to the prior art, so that the apparatus is capable of being used for mounting the building panels P at the third story, fourth story and higher, depending only on the lifting height of the crane or supportive mechanism S. Thus, the panel transferring means T which includes trolleys 24, 26, supporting boom 30, and trolley 32 supporting the hoist means 22 allows complete flexibility of movement of the panels P with respect to the frame structure F of the apparatus A of the present invention while in an elevated position. Further, the safety means 60 including safety rails 62, 64 are at a sufficient height to prevent a man from inadvertently falling from the frame structure F when the apparatus A is in an elevated position above the ground level. It should be noted that the inner side of the platform adjacent the building B need not be equipped with a permanent safety rail since it is disposed very close to the building structure B. However, a temporary safety rail may be affixed if the situation so warrants.

Thus, the apparatus A of the present invention is adapted to be used for installing building panels P safely on building structures B at elevations significantly above ground level such as the third story of a building, or higher, in a fast, safe, efficient manner.

The foregoing disclosure and description of the invention are illustrative and explanatory thereof, and various changes in the size, shape and materials as well as in the details of the illustrated construction may be made without departing from the spirit of the invention.

I claim:

1. An apparatus for mounting building panels on a building structure, said apparatus being movable from a lower level to an elevated position by a supportive mechanism, comprising:

a frame structure adapted to receive at least one man thereon, said frame structure having a base portion, vertical frame members mounted with said base portion and extending upwardly therefrom and a top portion including first and second channel members mounted with said vertical frame members in a fixed, substantially parallel spacial relation, said base portion adapted to receive a plurality of building panels thereon;

panel transferring means movably mounted with and supported by said top portion of said frame structure for raising a building panel off of said base portion of said frame structure for laterally moving the raised panel relative to said frame structure for positioning same for mounting on the building structure, said panel transferring means including:

a boom having a first end and a second end;

first and second channel trolley members, said first channel trolley member mounted on said first end of said boom and said second channel trolley member mounted on said boom between said first channel trolley member and said second end of said boom, said first and second trolley members being movably mounted with said first and second channel members, respectively; and, a movable trolley member being movably mounted on said boom and having hoist means for raising the building panel off of said base portion of said frame structure mounted therewith; and, releasable connecting means for releasably connecting said top portion of said frame structure with the supportive mechanism for elevating said frame structure from the lower level to the elevated position.

2. The apparatus of claim 1, wherein said hoist means includes:

a pulley mounted with said movable trolley member for use in raising the building panels off of said base portion of said frame structure.

3. The apparatus of claim 1, wherein said releasable connecting means includes:

a plurality of flexible lines mounted about said top portion of said frame structure terminating at a common upper point for receiving a hook-like member on the supportive mechanism.

4. The apparatus of claim 1, including:

safety means mounted with three vertical frame members of said frame structure to prevent personnel from inadvertently stepping or slipping off of said base portion of said frame structure.

* * * * *